US006334478B2

(12) United States Patent
Sakamoto et al.

(10) Patent No.: US 6,334,478 B2
(45) **Date of Patent: *Jan. 1, 2002**

(54) MOLD STRUCTURE FOR INJECTION MOLDING OF A LIGHT ALLOY AND METHOD OF INJECTION MOLDING A LIGHT ALLOY USING THE SAME

(75) Inventors: Kazuo Sakamoto; Kyoso Ishida; Yukio Yamamoto, all of Hiroshima (JP)

(73) Assignee: Mazda Motor Corporation, Hiroshima (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/161,833

(22) Filed: Sep. 29, 1998

(30) Foreign Application Priority Data

Sep. 29, 1997 (JP) ..... 9-263893

(51) Int. Cl.[7] ..... B22D 13/00; B22D 17/06

(52) U.S. Cl. ..... 164/113; 164/133; 164/306; 164/309

(58) Field of Search ..... 164/133, 113, 164/306, 309; 264/328.9, 328.12

(56) References Cited

U.S. PATENT DOCUMENTS 5,040,589 A 8/1991 Bradley et al.
5,066,449 A * 11/1991 Kato et al. ..... 264/328.12

FOREIGN PATENT DOCUMENTS

EP 0 572 683 A1 12/1993
EP 0 665 299 A1 8/1995
EP 0 718 059 A1 6/1996

* cited by examiner

*Primary Examiner*—M. Alexandra Elve
*Assistant Examiner*—Kevin McHenry
(74) *Attorney, Agent, or Firm*—Nixon Peabody LLP; Donald R. Studebaker

(57) ABSTRACT

In order to provide a die structure for injection molding of a light alloy free from gas defects, and a method of molding a light alloy parts using the die, the die structure is used for converting a light alloy into a semi-molten state, wherein a solid phase and a liquid phase coexist, or a molten state at a temperature just above a melting point and injecting the molten metal into an interior cavity portion, and $S_1/S_2$ of a gate sectional area $S_1$ with respect to a maximum sectional area $S_2$ of the cavity of the mold which area is almost perpendicular to the flowing direction of the melt therein is set in a range of 0.06 to 0.5.

10 Claims, 10 Drawing Sheets

$(L1-L2)/L1\times100 \geqq 25$

MOLD STRUCTURE FOR INJECTION MOLDING OF A LIGHT ALLOY AND METHOD OF INJECTION MOLDING A LIGHT ALLOY USING THE SAME

BACKGROUND OF THE INVENTION

1. Field of the Invention

The present invention relates to a die structure for injection molding of a light alloy free from casting defects, and method for injection molding using the same.

2. Prior Art

Light alloys containing of a matrix of aluminum or magnesium, particularly magnesium based alloys containing aluminum as an alloy component, have attracted special interest recently as materials, which are of light-weight and capable of securing a predetermined mechanical strength by means of plastic working such as forging. However, these light alloys show greatly thermal shrinkage during casting or molding, and this allows the fluidity to be lowered unless the casting temperature is raised in the gravity casting. Consequently, any perfect, sound cast free of cavity defect is not obtained. However, the high casting temperature of the melt can show the coarse-grained microstructure in the cast alloy because of low cooling rate in the cooling step of the casting process, then resulting in the reduce in workabilty of the material.

On the other hand, a desirably fine-grained structure can be obtained by die casting the alloy. In this process, since the molten metal is injected at a high pressure in a spraying state into a cavity of the mold, a great number of small voids or pores are left in the die cast due to a contained gas, and reduce mechanical strength of the cast so that any cast material having high properties can not be obtained. Particularly, for a thick-walled part, the strength is drastically lowered in this die casting process.

SUMMARY OF THE INVENTION

An object of the present invention is to provide a mold structure for injection molding a molten light alloy, capable of producing it with a fine-grained structure free from gas defects, then improving mechanical property of the light alloy cast material.

Another object of the present invention is to provide a method for injection molding a molten light alloy capable of producing it with a fine structure free from gas defects, then improving mechanical property of the light alloy cast material, then improve mechanical property of the light alloy cast.

The present invention provide a mold for injecting and a method for obtaining fine-grained microstructure free from casting defects such as blow holes or shrinkage voids in the alloy during injection molding.

In the invention, the molten metal is injected into the internal cavity of the die in a laminar flow state in the injection molding method, a fine structure free from gas defects can be obtained.

The present invention provides a mold structure for injection molding into an interior cavity portion through a gate a light molten alloy which is in a semi-molten state where a solid phase and a liquid phase of the alloy coexist or in a full molten state remaining at a temperature just above the liquidus point of the alloy, wherein a ratio S1/S2 of a sectional area S1 of the gate with respect to a maximum sectional area S2 of the internal cavity perpendicular to the molten metal flowing direction is set to be not less than 0.06.

According to the present invention, by setting the gate sectional area larger than such special value to the maximum sectional area of the internal cavity portion in the direction perpendicular to the metal flowing, or poured, direction toward the cavity, the molten alloy can become in the laminar flow state in the cavity. As a result, no generation of such gas defects as blow holes or shrinkage voids is substantially observed in the injection-molded product produced.

For the injecting mold of the invention the lower limit of the areal ratio S1/S2 should be 0.06. As the areal ratio S1/S2 is less than 0.06, as shown in FIG. 3, the relative density of the product is drastically lowered because the generation rate of such gas defects increases.

On the other hand, the upper limit of the areal ratio S1/S2 of the mold preferably may be 0.50. As the ratio S1/S2 is more than 0.5, the relative density of the molded material would be on almost the same level as that of the conventional die cast, causing an advantage of using such semi-melt injection molding method to disappear.

In the case where a thick-walled product is molded, in the melt filled in the corresponding thick portion of the cavity is apt to be finally solidified to produce shrinkage cavities or voids in the portion. In this case, it is preferred to insert core pins into the internal cavity portion of the mold, and then, in use, to pressurize the molten metal by push the core pins inward the cavity immediately after pouring, thereby to prevent shrinkage cavities from occurring during solidification. Thus the core pins cause the semi-molten alloy which is solidifying to flow plastically, resulting in crushing of the shrinkage cavities in the product.

However in this case of the thick-walled product, as a solid fraction (a volume fraction of the solid phase in the semi-molten melt) is low in the melt, the gas defects tends to be formed in the alloy product. The solid fraction lower than 10% causes both the relative density and tensile strength to be rapidly lowered as shown in FIGS. 7 and 8. Accordingly, for production of the thick-walled product, the semi-melt injection molding is preferably performed at the solid fraction which may be prepared to be not less than 10%.

With the decrease of the solid fraction, the average solid grain size is liable to become small and the creep characteristics at high temperature are liable to be lowered as shown in FIG. 6. To secure the predetermined creep characteristics, injection molding must be performed under the condition that not only the solid fraction is not less than 5%, but also the average crystal grain size in the solid phase contained in the melt is not less than 50 $\mu$m.

The relative density of the injection-molded material of the present invention can be improved by optionally pressed or forged. The draft (a ratio of difference of the an initial thickness and the deformed thickness of the material with respect to the initial thickness) due to pressing or forging should be set to not less than 25%. The reason is that the relative density, as shown in FIG. 4, is rapidly increased from the draft of 20% and is saturated at 25%.

The method of the present invention is preferably applied to magnesium based alloy containing 4 to 9.5% by weight of aluminum as a main alloying component, as the light alloy. When the aluminum content is smaller than 4% by weight, an enhancement in mechanical strength is not expected. On the other hand, when the content exceeding 9.5% by weight can significantly lower workability (by limiting upsetting rate).

The light alloy obtained by the present method is preferably subjected to heat treatment for Temper T6 (composed of a solution treating followed by an artificial aging) for further improving the mechanical strength.

Thus, the present invention can provide the molded material of a light alloy free from gas defects by injection molding process, so that such molded material, even if it may have a rough shape, can be forged into a final product having excellent mechanical strength and precise dimensions.

EMBODIMENT FOR CARRYING OUT THE INVENTION

The embodiment for carrying out the invention will be described in detail with reference to the accompanying drawings.

Figure 1A:
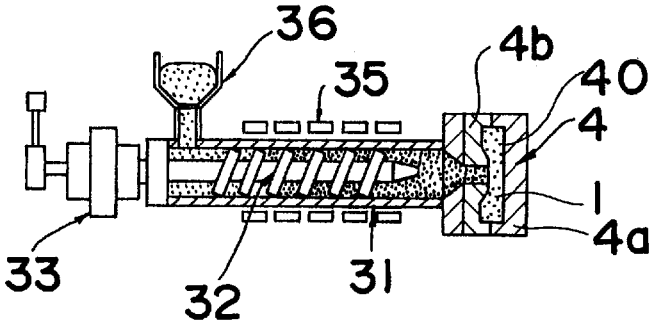
FIGS. 1A to 1F are views showing the whole steps of a semi-melt molding process including a forging process after thereof in the invention.
Figure 1B:
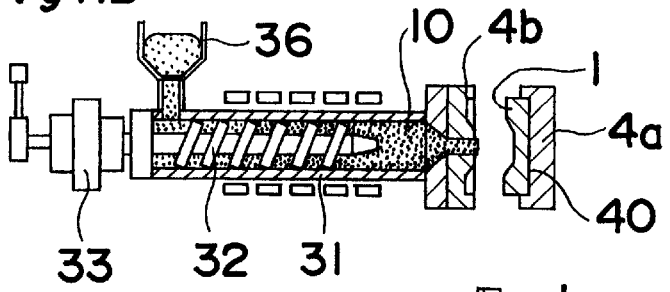

A magnesium based alloy is injection-molded by using a semi-melt injection molding machine, as shown in FIGS. 1A and 1B. In these Figures, a cylinder 31 is provided with a screw 32 therein, a high-speed injection mechanism 33 at the rear end and a mold 4 at the front end. The mold 4 comprises two separable half-molds 4*a* and 4*b* having each plans in contact with each other, in which each concave to form at least a cavity 40 for molding is shaped.

A plurality of heaters 35 are arranged around the cylinder 31 in the fixed intervals along the cylinder axis, which thereby heat and melt the alloy material in order while the material is being charged through a hopper 36 provided at the inlet end of the cylinder 31.

The molten material, which is heated at a predetermined temperature in the cylinder 31, is pressurized by pushing the screw rotor 32 inside the cylinder 31 toward the front end and then injected into the cavity in the mold 4, to solidify the solid body to be shaped to the inversive inner profile of the cavity 40.

Figure 1C:
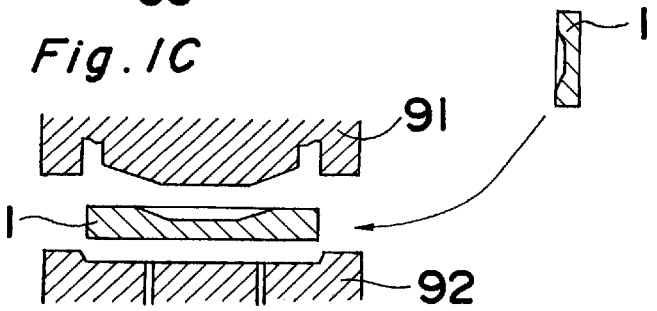
Figure 1D:
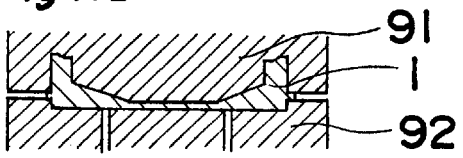
Figure 1E:
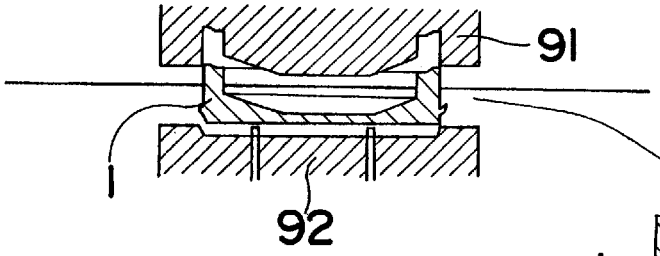
Figure 1F:
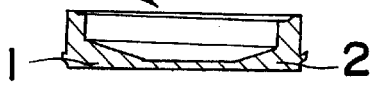

The injection-molded rough-surfaced product 1 is removed after the half-molds 4*a* and 4*b* are separated as shown in FIG. 1B, and then placed and forged between an upper a lower forging dies 91 and 92 as shown in FIGS. 1C and 1D. The product 1 is separated between the forging dies 91 and 92 as shown in FIG. 1E to obtain a forged product 2 as shown in FIG. 1F. Thereafter, the forged product 2 is machined for finishing and then subjected to heat treatment to temper T6.

In the following examples, the Alloys A to C were used as magnesium based alloy, and as such molding machine, Model JLM-450E manufactured by Nippon Seikosho Co. may be used under the conditions as an example shown in Table 2.

TABLE 1

| Composition of Magnesium Alloy (wt %) | | | | | | | |
|---|---|---|---|---|---|---|---|
| | Al | Zn | Mn | Fe | Cu | Ni | Mg |
| Alloy A | 7.2 | 0.7 | 0.17 | 0.002 | 0.001 | 0.008 | Bal |
| Alloy B | 6.2 | 0.9 | 0.24 | 0.003 | 0.001 | 0.008 | Bal |
| Alloy C | 9.2 | 0.7 | 0.22 | 0.004 | 0.002 | 0.008 | Bal |

TABLE 2

| Condition of Injection Molding | |
|---|---|
| Injection pressure | 80 Mpa |
| Injection speed | 2 m/sec |
| Mold temperature | 180° C. |

EXAMPLE 1

The mechanically cut pellets of the magnesium alloy C, having the composition as shown in the Table 1, are charged into the hopper 36 of the above injector. In the heating cylinder 31, the powder is heated at a temperature adjusted such that pellets begin to be gradually molten when moved at the position of about ¼ of the whole length in the interior of the cylinder from the hopper and to reach the desired solid fraction in the state of solid liquid phases mixture at the position of about ½ of the whole length from the hopper. On adjusting the melt to the solid fraction of about 10% prior to injecting, it was injected into the mold so as to obtain the average solid grain size of about 50 μm in the molded alloy.

Figure 2:
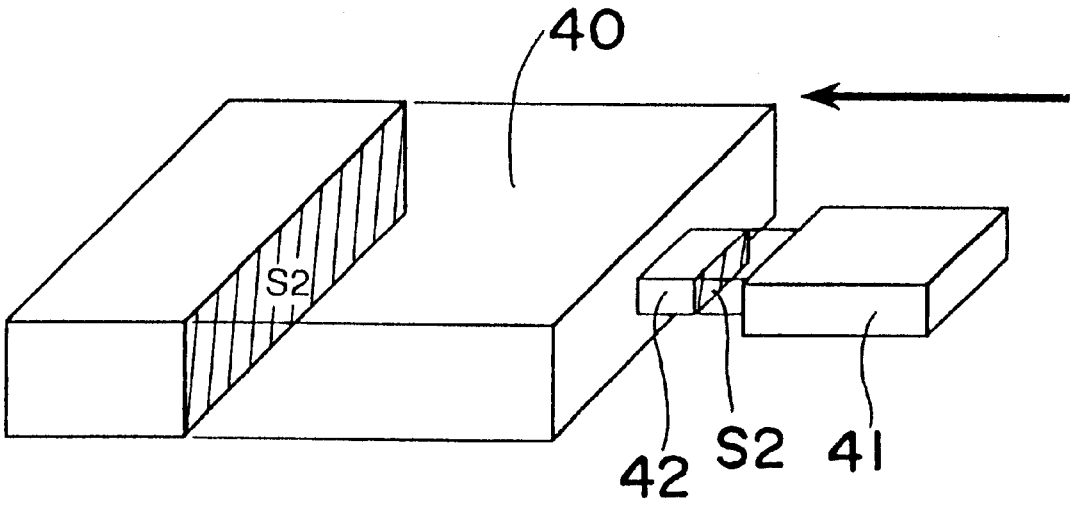
FIG. 2 is a schematic diagram showing a mold structure for the semi-melt molding method of the present invention.
Figure 3:
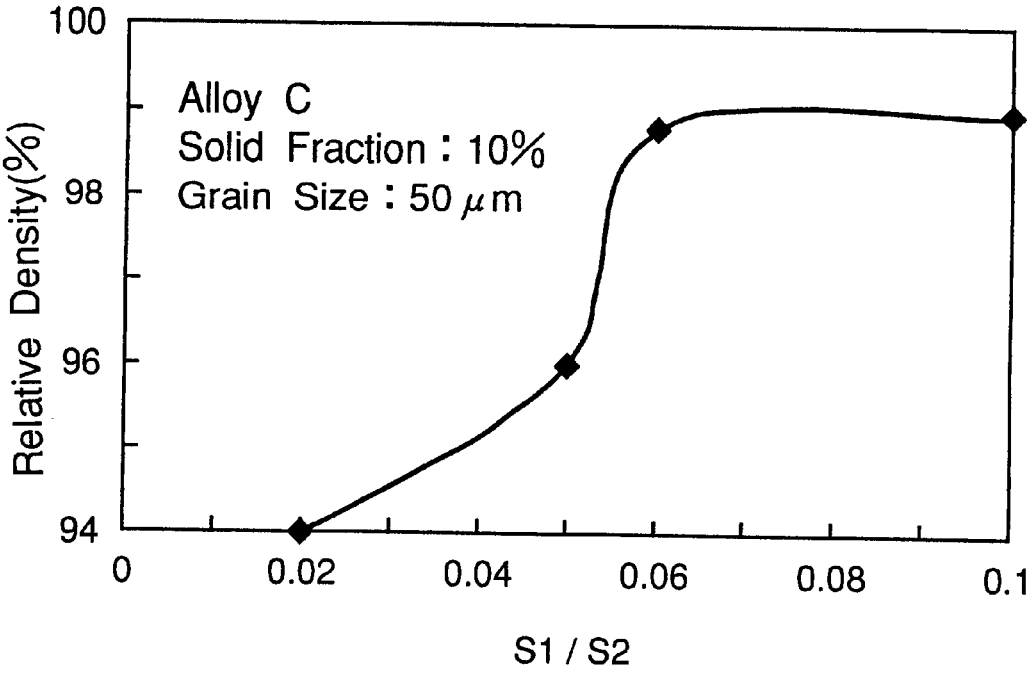
FIG. 3 is a graph showing a relation between the ratio of the gate sectional area S1 to maximum sectional area S2 in the product portion poured in the cavity and the relative density of the product made by the semi-melt molding method of a magnesium alloy.

It is seen that a significant change in relative density occurs at 0.06 of the areal ratio S1/S2 of the gate sectional area S1 to the maximum sectional area S2 of the internal cavity portion almost perpendicular to the molten metal flow direction as indicated as an arrow as shown in the schematic diagram of the mold structure of FIG. 2. FIG. 3 shows that as the areal ratio S1/S2 is more than 0.06, the relative density is saturated at 99%, as shown in.

Figure 4:
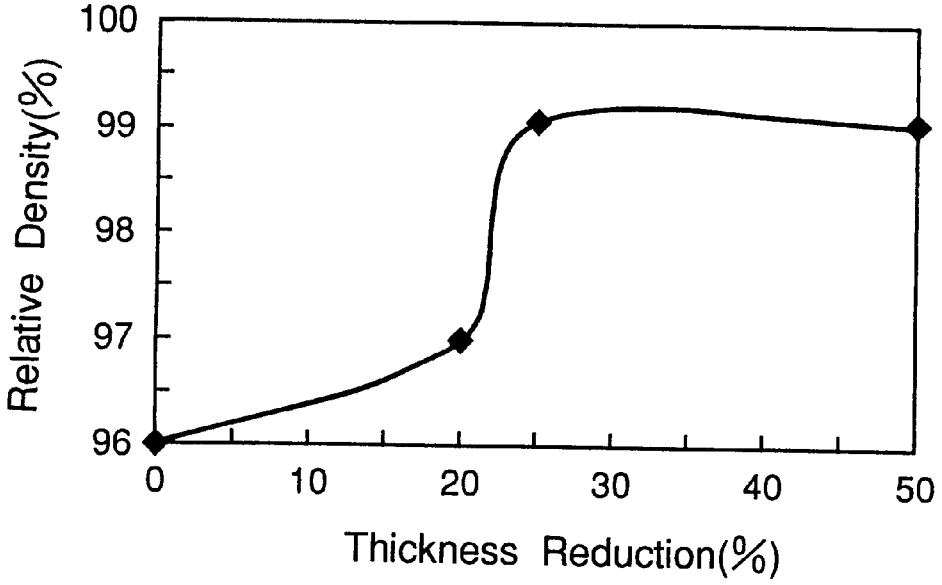
FIG. 4 is a graph showing a relation between the rolling area reduction and the relative density of the product by injection molding the semi-molten material obtained by the present invention.

Then, a sample of a shape of 16 cm in diameter and 22.5 mm in length, having the relative density of 96%, was made of the injected-molded material of the above alloy C and forged at the temperature of 300° C. to different forging draft percentages. A relation between the forging draft and the relative density of the product is shown in FIG. 4. The relative density increases with a increase in forging draft. The relative density is 99% at the forging draft of 25%, and is saturated with the higher draft.

The injection-molded materials were prepared by injection-molding the above alloy C under the conditions that the average solid grain size is fixed to 50 μm and the solid fraction is changed, using a mold of the area ratio S1/S2 of 0.1. Creep characteristics of the resulting injection molded materials was examined at 125° C. under 50 MPa. The solid fraction was determined by measuring the area proportion in the microstructure of the molded product, using image analysis.

Figure 5:
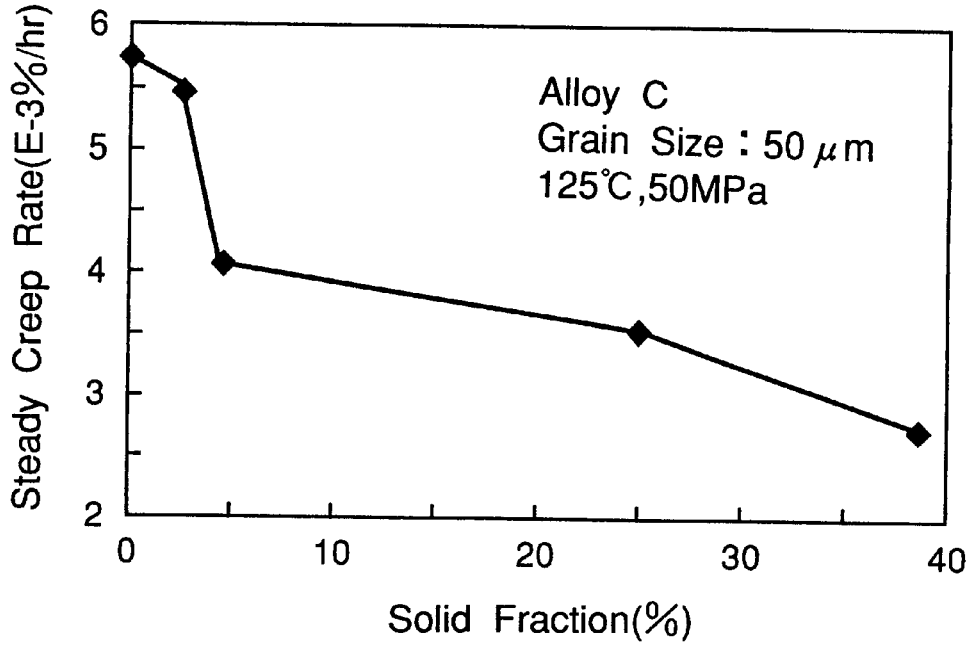
FIG. 5 is a graph showing a relation between the solid phase fraction and the steady creep rate of the injection-molded material obtained using the method of the present invention.

As is apparent from FIG. 5, the steady creep rate ($X10^{-3}$%/hr) is lowered with a increase in solid fraction , and the excellent high-temperature creep characteristics are obtained at the solid fraction of not less than 5%.

For investigation of the creep characteristics, the injection-molded materials were prepared by injection-molding the same alloy C under the conditions that the average solid fraction was fixed constant and the average crystal grain size (μm) of the solid phase in the melt was changed, using a mold having the areal ratio S1/S2 of 0.1.

Figure 6:
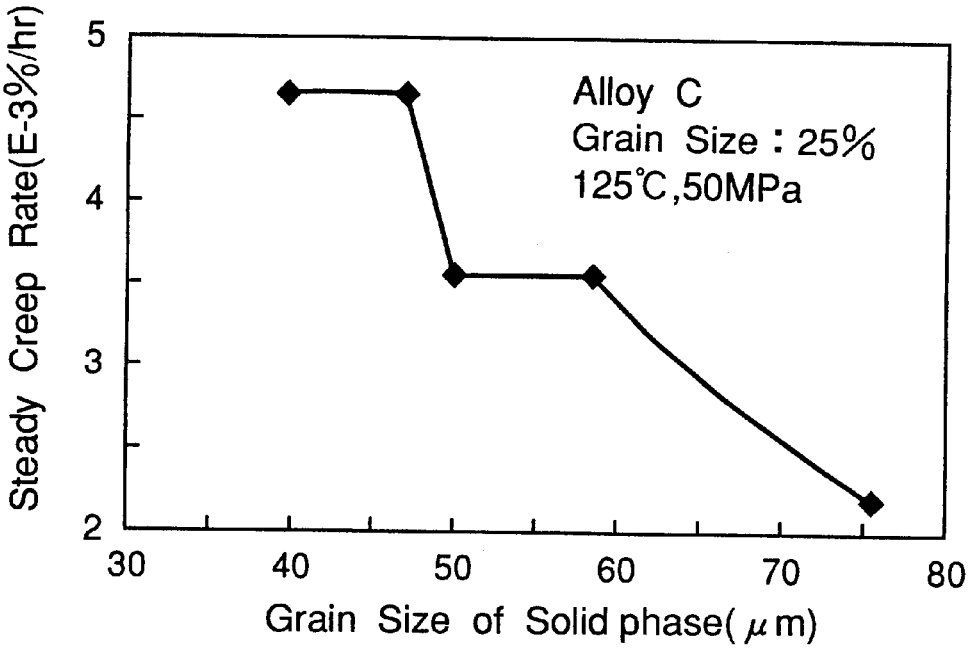
FIG. 6 is a graph showing a relation between the mean grain size of the solid phase in the semi-molten alloy and the steady creep rate of the injection-molded material obtained using the method of the present invention.

Steady creep rates of the resulting injection molded samples were examined at 125° C. at a constantly applied tensile stress of 50 MPa. FIG. 6 shows the obtained relation between the average solid fraction and steady creep rate, in which steady creep the rate is decreased with a increase in solid grain size. Thus, the excellent high-temperature creep characteristics are obtained at the solid fraction of not less than 5%.

EXAMPLE 2

In the same manner as described in Example 1 except for using alloys A and B as specified in Table 1, injection molding was performed and the relation between the solid fraction and the relative density of the alloys A and B was studied wherein the grain size of the solid phase was adjusted to 10%.

Figure 7:
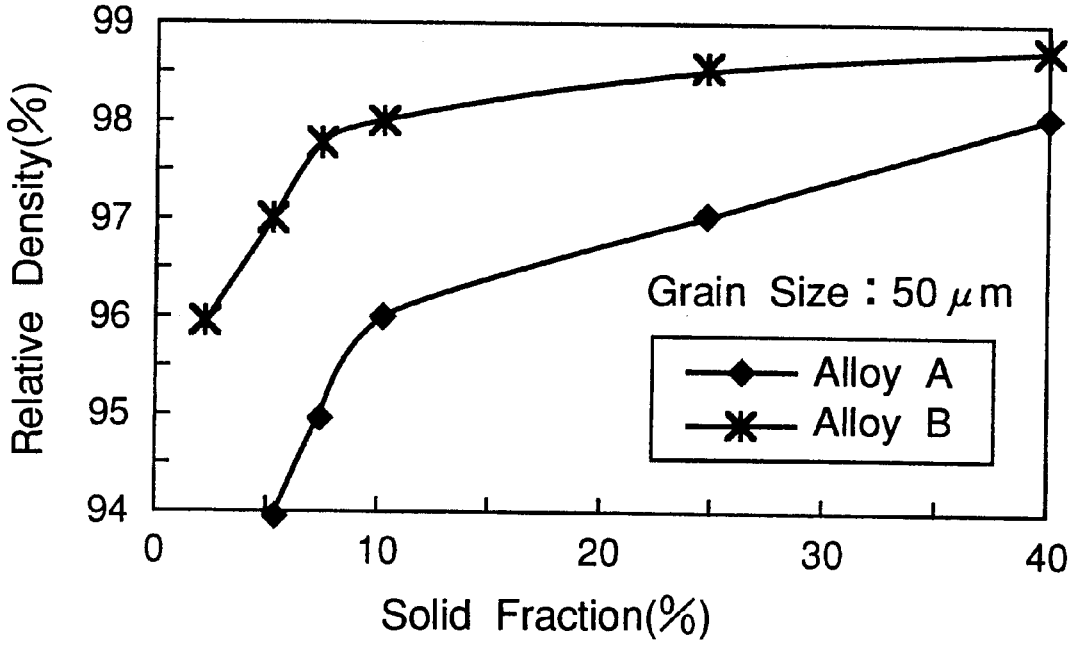
FIG. 7 is a graph showing a relation between the solid fraction and the relative density of the injection-molded material obtained by the method of the present invention.

The results are shown in FIG. 7. As the solid fraction is below 10%, the relative density is rapidly lowered, and as it is over 10%, the relative density gradually increases. Thus, it is found that high relative density is obtained with the solid fraction in excess of 10%, dependently on the alloy composition.

The Alloy B is apt to show poorer run as a melt in a cavity of the mold and apt to be lower in density as a solids than the Alloy A, on the same conditions of molding with respect to moth the Alloys.

Figure 8:
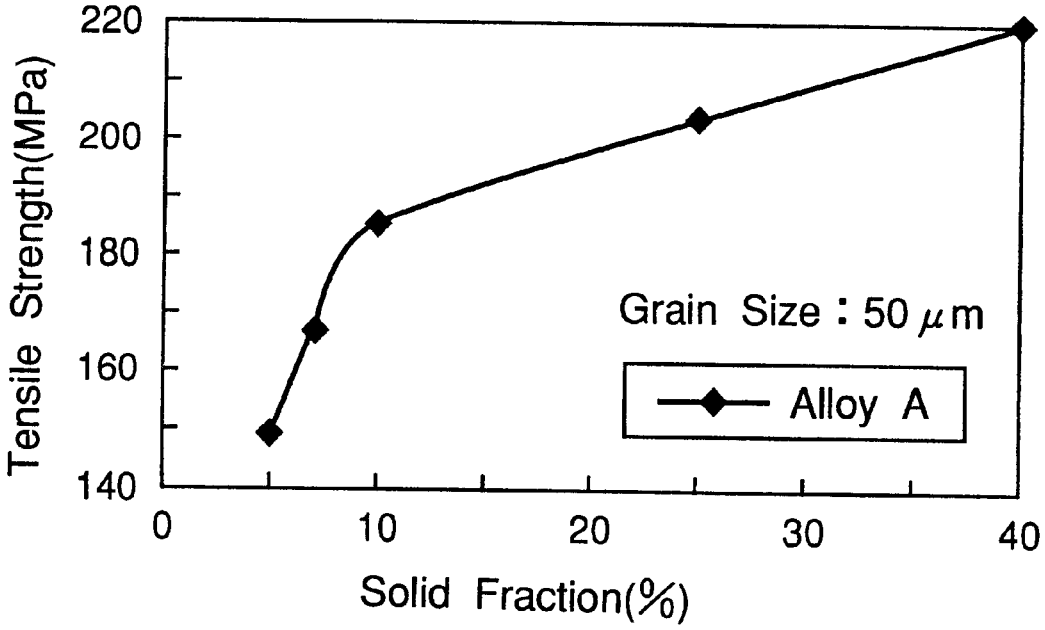
FIG. 8 is a graph showing a relation between the solid fraction and the tensile strength of the injection-molded material obtained using the method of the present invention.

For Alloy A with the solid grain size of 50 μm, the relation between the solid fraction (%) and tensile strength (MPa) is shown in FIG. 8. It is also found that a rate of a change of the tensile strength to the solid fraction varies at the solid fraction of 10%. Accordingly, it is necessary to perform injection molding free from gas entrapment using a mold whose area ratio S1/S2 is not less than 0.06 in order to obtain high tensile strength. It is also found it necessary to perform injection molding at the solid fraction of not less than 10%.

EXAMPLES 3 and 4

The Alloy C was injection molded using the mold having the areal ratio S1/S of 0.2, at the solid fraction of 10% in the same manner as described in Example 1.

In Example 3, the cavity of the mold was evacuated for 5 seconds before injection and the injection pressure was maintained to the melt filled in the cavity at 80 MPa until solidification of the melt has finished.

In Example 4, evacuation was not performed and the injection pressure was maintained at 80 MPa until solidification has finished.

In Comparative Example 1, evacuation was not performed and the injection pressure was maintained at a lower level of 25 MPa until solidification have finished.

Figure 9:
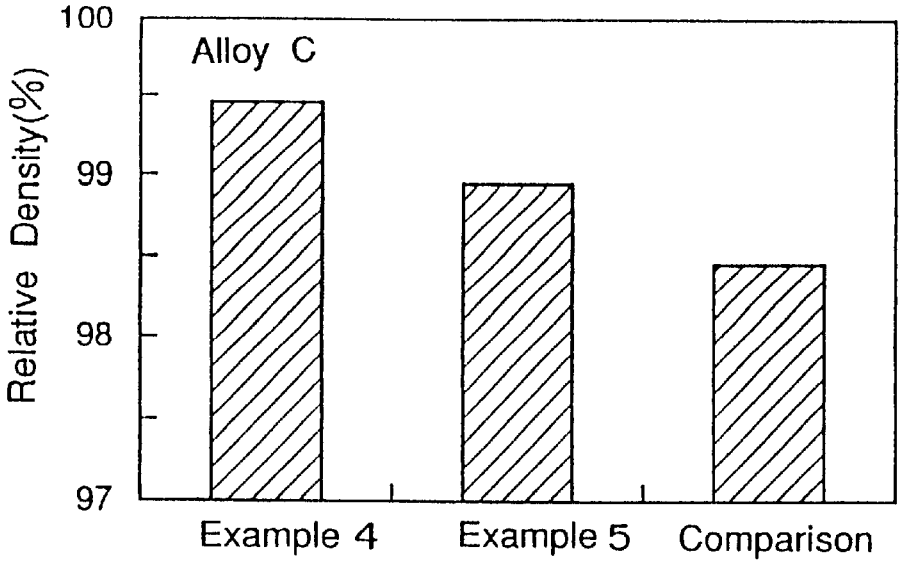
FIG. 9 is a bar graph showing the relative density of the injection-molded material obtained by the method of the present invention, compared with a conventional molding method.

As is apparent from the results as shown in FIG. 9, the combination of evacuation of the molding cavity and maintenance of the injection pressure is effective for enhancement of the relative density, because they prevent gas defects and shrinkage cavities during molding.

Figure 10:
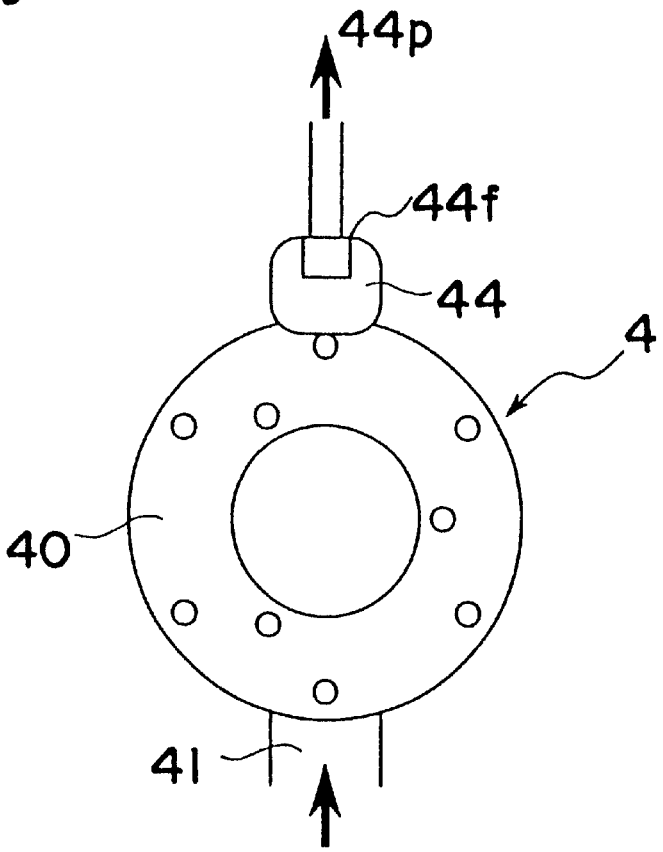
FIG. 10 shows a top plan view of the molding cavity arranged in the mold of a embodiment of a die used in the method of the present invention.

Maintenance of the injection pressure is performed for the purpose of avoiding a pressure-unloaded state caused by a working time-rag in turning on or off a pressure switching valve. As shown in FIG. 10, a filter 44*f*, having pores whose diameter is smaller than that of the solid grain size of the solid phase in the molten light alloy, may be provided in an overflow 44 of the mold 40, allowing the molten metal not to be transferred to the evacuation path 44*p* of the mold.

EXAMPLE 5

Figure 11:
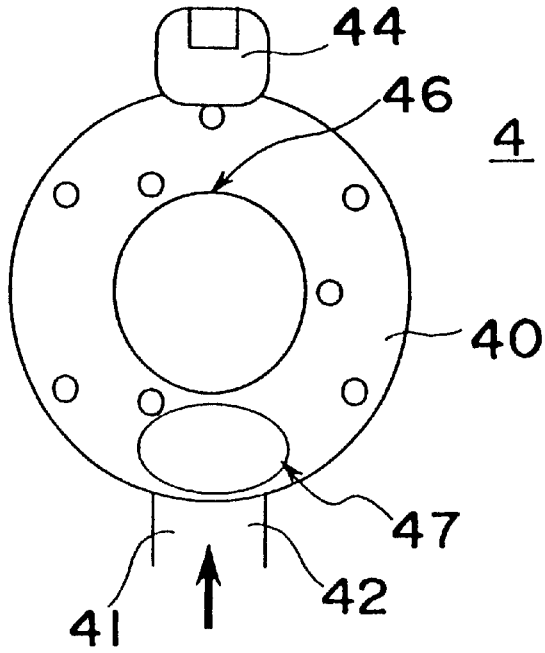
FIG. 11 shows a top plan view showing the molding cavity having the positions where penetration and casting crack easily apt to occur in the conventional injection molding.

For the mold as shown in FIG. 11, as the alloy, which easily is apt to be subjected to casting crack of the molded body or sticking to the molding cavity in molding, is injection molded in the mold at the area ratio S1/S2 of not less than 0.06, sticking of the body to the mold occurs at the thermal sticking position 47 where a distance between the wall portion of the cavity to be initially contact with the molten metal and a gate 42 is minimum. On the other hand, casting crack is apt to occur at the latest reached position 46 at which the latest flow of the molten metal finally arrives in the cavity in, with a great amount of the cooled then and solidified metal in the melt included.

Figure 12:
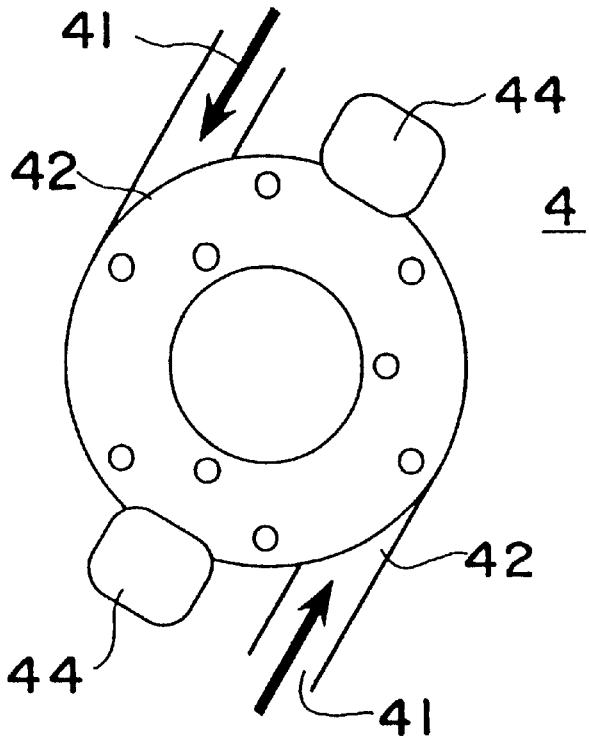
FIG. 12 shows a top plan view of the molding cavity in another embodiment of a die used in the method of the present invention.

Therefor, it is preferred to set the position of the gate in the mold such that the distance between the side wall of the cavity initially contact with the molten metal and the gate is elongated as far as possible, and to contrive the mold design of reducing the speed of the molten metal when the mold side wall is contacted therewith. For example, in the case of a ring-shaped product to be molded, preferably at least two gates 42 and 42 are provided separately around the rim of the ring, as shown in FIG. 12, thereby to adjust the injecting speed of the molten metal from the gates to not less than 30 m/second and to supply the molten metal flow along the tangent line to the center of the ring.

Figure 13:
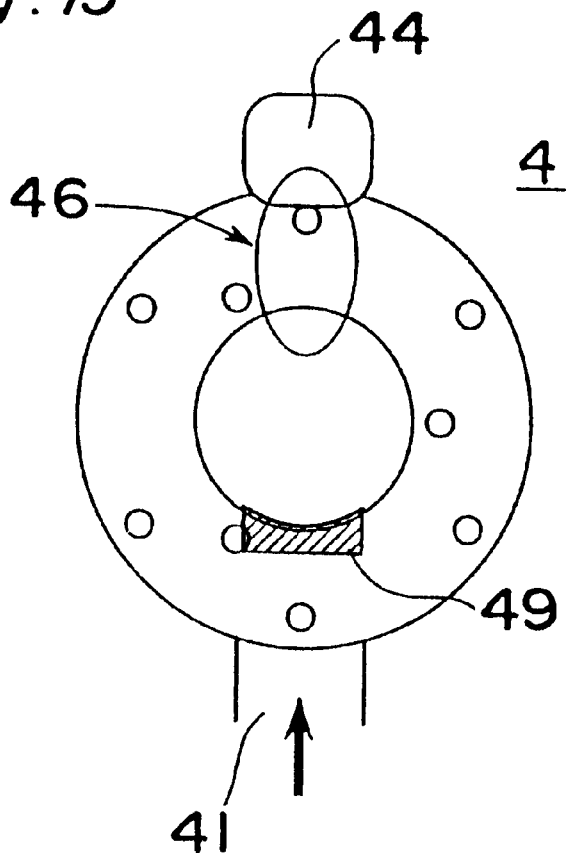
FIG. 13 shows a top plan view of the molding cavity in a further different embodiment of a die used in the method of the present invention.

In another example, as shown in FIG. 13, a porous material 49 is arranged on the side wall of the cavity to be in earliest contact with the injected molten metal, thereby making it possible to reduce the metal flow speed when the mold side wall is contacted with the molten metal. Also, it is preferable to enhance the solid fraction in the melt at the latest reached portion 46 at which the molten metal reaches the latest.

Furthermore, the temperature of the melt may controlled in the respective heating zones by heaters 35 around the injection cylinder 31, thereby to change the solid fraction in the molten alloy longitudinally along the cylinder 31, as shown in FIG. 1A. By enhancing the solid fraction inside the cylinder 31 in a part of the melt present, for example, on the rear side thereof, it is possible to enhance the solid fraction at the portion in the cavity which the molten metal reaches finally.

Figure 14:
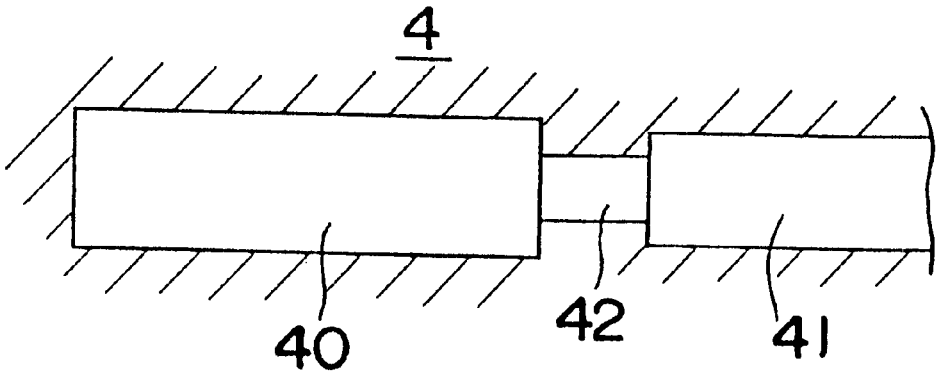
FIG. 14 is a top plan view showing a furthermore different embodiment of a die used in the method of the present invention.

The cavity of mold may have a form of rectangular hexahedron. In this case, the gate 42 connected with the runner 41 is preferably provided at the end portion of tha cavity 40 elongated in the longitudinal direction, as shown in FIG. 14, to elongate the distance between the side wall of the cavity 40 to be contact with the earliest molten metal as long as possible.

EXAMPLE 6

Figure 15A:
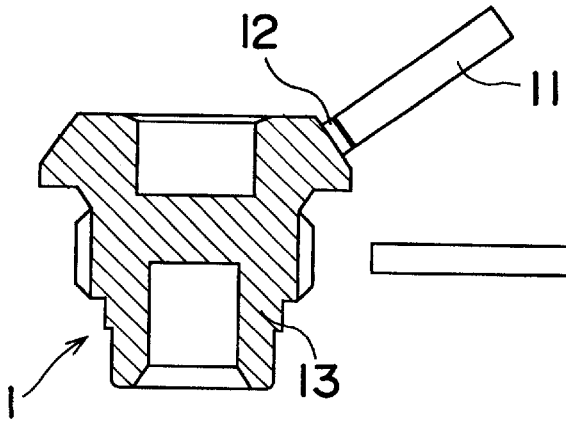
FIGS. 15A and 15B are schematic sectional views showing a method of removing a gate and a runner from the injection-molded product by the method of the present invention.
Figure 15B:
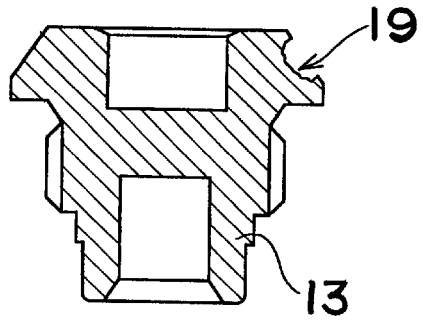

In the present invention, when the sectional area of the gate 42 is enhanced to area the ratio S1/S2 is greater than 0.06, a pealed or broken defect is apt to occur at the root portion of the gate 12 of the product 1 at the time of separation of the runner 11 by cutting it at the gate, as shown in FIGS. 15A and 15B.

Figure 16A:
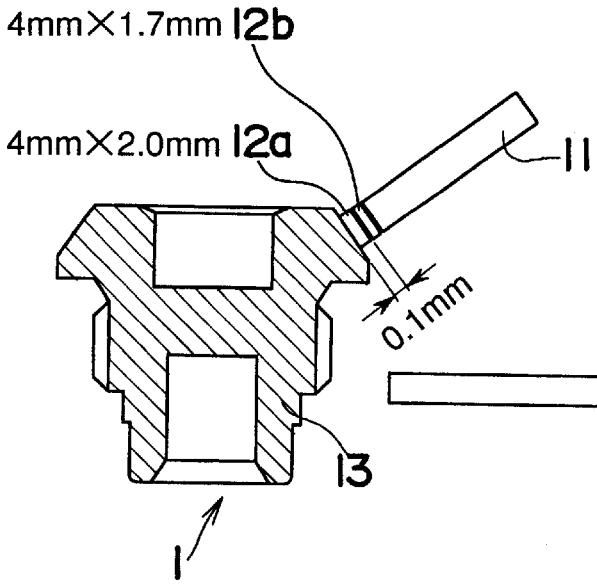
FIGS. 16A and 16B are schematic sectional views showing an improved method of removing a gate and a runner from the injection-molded product obtained by the method of the present invention.
Figure 16B:
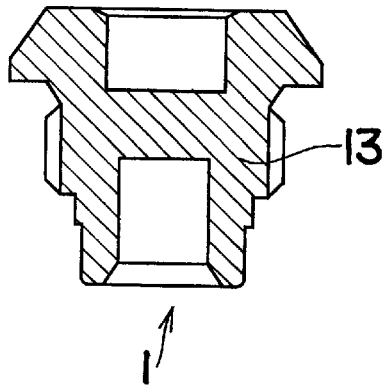

Therefore, it is preferred to constitute a two-stage gate structure, as shown in FIG. 16A, wherein the area of the gate 12*a* (for example, section of the gate; 4 mm in width, 2.0 mm in thickness) on the cavity side (product side) is larger than that of the gate 12*b* (for example, section of the gate; 4 mm in width, 1.7 mm in thickness) which is on the runner side and away by 0.1 mm from the cavity. After molded, the product is separated at the smaller (thinner) gate 12*b* from the runner by bending the runner, and the remaining portion of the runner, or the gate 12*a,* on the product surface is then ground to be removed; consequently, the smooth surface at the portion of the product can be easily obtained, without forming such a pealed defect due to the gate, as shown in FIG. 16B.

EXAMPLE 7

Figure 17:
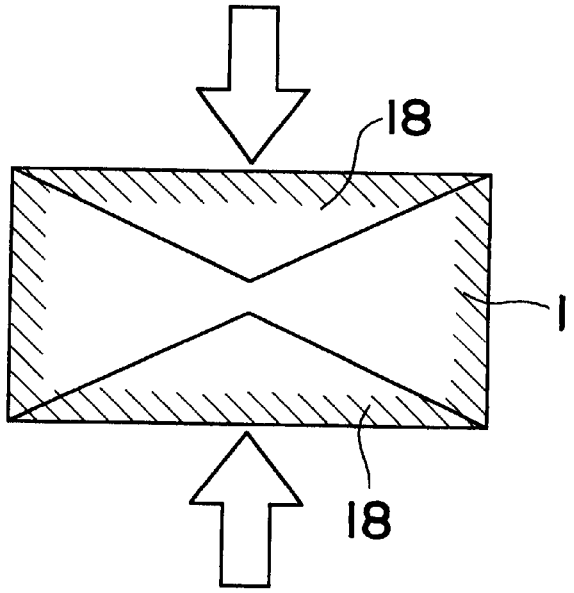
FIG. 17 is a sectional view showing a non-deformed area to remain in a metal block during the forging step.
Figure 18A:
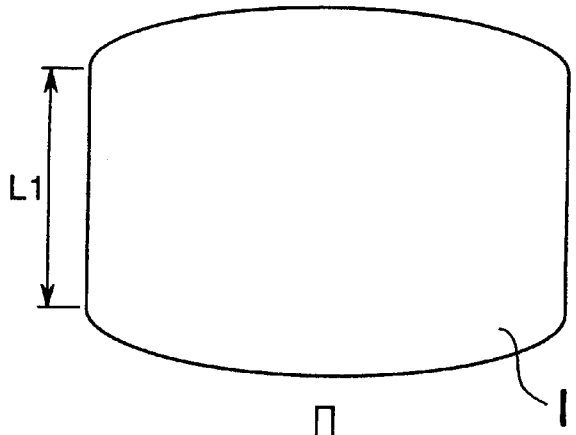
FIGS. 18A and 18B are schematic sectional views showing a profile of the injection-molded material before and after forging said material, which is obtained by the method of the present invention.
Figure 18B:
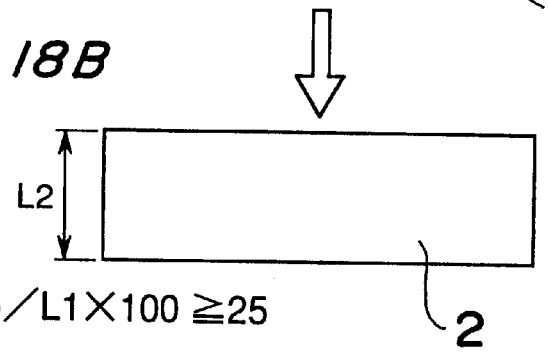

In case of uniform forging, a pair of non-deformed regions 18 and 18 are formed in the material 1 under the center upper and lower surfaces which are pressed opposite to each other, as shown in FIG. 17, and shrinkage cavities in the region thereof is possible to be left without being crushed. To densify the injection molded product 1, it is preferred to forge the product at the minimum forging draft not less than 25% in not only the non-deformed portion but also the upper and lower center surfaces. In order to forge the product into a rectangular cross section, an injection-molded product 1 may be molded in advance into a barrel-shaped cross section, in which the central upper and lower surfaces to be pressed are expanded as shown in FIG. 18A, and then such injection-molded product 1 may be forged so as to deform the portions under the convexed barrel surfaces with higher draft. Thus, a forged product 2 having a rectangular cross section is formed by forging, as shown in FIG. 18B.

As described above, the various effects of the present invention using the magnesium alloys was confirmed in those examples. The relations of the solid fraction and grain size to the mechanical strength or creep characteristics are phenomena peculiar to the light alloy to be injection-molded from the semi-molten state, and therefore, the method of the present invention is widely applicable to light alloys containing magnesium and aluminum to improve such mechanical properties.

What is claimed is:

1. A mold structure for injection molding into an interior cavity portion of the mold through a gate adjacent to the cavity a molten light alloy in a semi-molten state which has a solid fraction of not less than 10%, wherein the gate and the cavity are set to be in a range of 0.06 to less than 0.2 of an areal ratio S1/S2 of a sectional area S1 of the gate with respect to a maximum sectional area S2 of the cavity perpendicular to the molten metal flow direction.

2. The mold structure according to claim 1, wherein the gate is a two-stage gate structure comprising a first and a second gates in series in which the area of the first gate near the internal cavity side is more than that of the second gate on the runner side.

3. A method of molding a light alloy product, comprising steps of:

preparing a light alloy material into a semi-molten state which has a solid fraction of not less than 10%; and injecting the molten metal into an internal cavity of a mold through a gate, wherein the mold comprises the gate and the cavity being set to be in a range of 0.06 to less than 0.2 of an areal ratio S1/S2 of a sectional area S1 of the gate with respect to a maximum sectional area S2 of the cavity which is perpendicular to the molten metal flow direction.

4. A method of molding a light alloy product, comprising steps of:

preparing a light alloy material into a semi-molten state where a solid phase and a liquid phase coexist, wherein a solid fraction of the molten metal is not less than 5%, and the average grain size of the solid phase is not less than 50 $\mu$m; and injecting the molten metal into an interior cavity of a mold through a gate, wherein the mold comprises the gate and the cavity being set to be in a range of 0.06 to less than 0.2 of an areal ratio S1/S2 of a sectional area S1 of the gate with respect to a maximum sectional area S2 of the internal cavity which is perpendicular to the molten metal flow direction.

5. The method according to claim 3, wherein the light alloy comprises a magnesium based alloy containing 4.0–9.5% of Al by weight.

6. The method according to claim 3, wherein prior to the step of injecting, the internal cavity of the mold is evacuated for a short time immediately before injecting.

7. The method according to claim 3, wherein the method further comprises a step of solution heat-treating and then artificially aging the product to Temper T6.

8. The method according to claim 4, wherein the light alloy comprises a magnesium based alloy containing 4.0–9.5% of Al by weight.

9. The method according to claim 4, wherein prior to the step of injecting, the internal cavity of the mold is evacuated for a short time immediately before injecting.

10. The method according to claim 4, wherein the method further comprises a step of solution heat-treating and then artificially aging the product to Temper T6.

* * * * *